US008407849B2

(12) United States Patent
Chen

(10) Patent No.: US 8,407,849 B2
(45) Date of Patent: Apr. 2, 2013

(54) CLEANING TOOL

(76) Inventor: Sword Chen, Wuyi County (CN)

( * ) Notice: Subject to any disclaimer, the term of this patent is extended or adjusted under 35 U.S.C. 154(b) by 0 days.

(21) Appl. No.: 13/269,187

(22) Filed: Oct. 7, 2011

(65) Prior Publication Data

US 2012/0222226 A1 Sep. 6, 2012

(30) Foreign Application Priority Data

Mar. 1, 2011 (CN) ..... 2011 2 0058332 U
Jun. 24, 2011 (CN) ..... 2011 1 0188805

(51) Int. Cl.
*A47L 13/58* (2006.01)

(52) U.S. Cl. ..... 15/260; 15/229.1; 15/229.2; 15/263; 34/58

(58) Field of Classification Search ..... 15/119.1, 15/229.1, 229.2, 260, 263, 228; 34/58
See application file for complete search history.

(56) References Cited

U.S. PATENT DOCUMENTS 7,743,528 B2 * 6/2010 Lin ..... 34/58
7,909,174 B1 * 3/2011 Yu ..... 210/403
8,028,369 B2 * 10/2011 Chiang ..... 15/260
8,056,179 B2 * 11/2011 Hsu ..... 15/260
8,065,777 B2 * 11/2011 Lin ..... 15/260
8,156,607 B2 * 4/2012 Chiang ..... 15/260
2009/0307855 A1 * 12/2009 Kao ..... 15/3
2011/0000046 A1 * 1/2011 Chen et al. ..... 15/260
2011/0154607 A1 * 6/2011 Chen ..... 15/260
2011/0173770 A1 * 7/2011 Chen ..... 15/260
2011/0185532 A1 * 8/2011 Lin ..... 15/260
2011/0197463 A1 * 8/2011 Shih ..... 34/108
2011/0225752 A1 * 9/2011 Yu ..... 15/119.1
2011/0225762 A1 * 9/2011 Tsai ..... 15/260
2012/0047675 A1 * 3/2012 Chu ..... 15/260
2012/0090122 A1 * 4/2012 Lin ..... 15/228

* cited by examiner

*Primary Examiner* — Monica Carter
*Assistant Examiner* — Michael Jennings
(74) *Attorney, Agent, or Firm* — Leason Ellis LLP

(57) ABSTRACT

A cleaning tool includes a mop which includes at a lower end a mop head with a wiping object. The mop includes a mop rod formed of an inner rod and an outer rod and a drive mechanism is used to convert the telescoping motion of the mop rod to rotation motion of the mop head. The drive mechanism is a variable speed drive mechanism. As a result, the mop head of the cleaning tool achieves different rotation speeds under dry working condition with a lower resistance compared to washing conditions with a higher resistance. During washing, the mop head is washed rotationally at a lower speed, and the washing operation is conducted through depressing the mop rod.

13 Claims, 13 Drawing Sheets

CLEANING TOOL

BACKGROUND OF THE INVENTION

1. Technical Field

The present invention relates to a cleaning tool.

2. Description of Related Art

Currently, there are many cleaning tools with various structural forms. For instance, a Chinese Patent No. CN201020195246.6 discloses a "mop bucket and its mop". In this technical scheme, the mop bucket is provided with a washing part and a drying part, wherein the drying part is equipped with a drying basket configured on the installation seat which is higher than the bottom of the bucket, and the washing part is equipped with a rotatable washing rack which is configured at the lower part of the washing part. When drying the mop, the user shall put the hand pressing type mop in the drying basket, and then depress the mop rod to drive the mop head and the drying basket to rotate, thus realizing centrifugal drying. When washing the mop, the user shall put the hand pressing type mop on the cleaning rack and then depress the mop rod to drive the mop head to rotate, which further drives the water in the bucket to rotate, thus the mop head is cleaned. During drying, when depressing the mop rod, the water-contained mop head can be dried rapidly since the rotation resistance is low. However, during washing, the mop head is put in the washing part, so the wiping object on the mop head will contact with the bucket wall. Moreover, it is required to drive the water in the washing bucket to rotate with a high resistance. Therefore, washing the mop by depressing the mop rod requires a lot of labor.

BRIEF SUMMARY OF THE INVENTION

One object of the present invention is to provide a labor-saving cleaning tool easy for drying and washing operations.

To realize the object above of the present invention, the following technical scheme is adopted:

A cleaning tool according to one embodiment includes a mop bucket and a mop. The lower end of the mop rod is provided with a mop head with a wiping object, and the mop rod includes an inner rod and an outer rod. The inner rod has a lower end that connects with the mop head, and the inner and outer rods are sleeved and joint with each other. The tool also includes a drive mechanism, used to convert the telescoping motion of the mop rod to the rotational motion of the mop head, is mounted between the inner rod and the outer rod. A rotatable drying basket is accommodated in the mop bucket. During drying, the mop head is put in the drying basket and the drive mechanism drives the mop head and the drying basket to rotate unidirectionally. The mop bucket is provided with a rotatable washing head on which the mop head is put during washing. The drive mechanism drives the mop head to rotate unidirectionally. In accordance with the invention, the drive mechanism is a variable speed drive mechanism; during drying, the mop rod is depressed and the variable speed drive mechanism drives the mop head to rotate at a first rotation speed. During washing, the mop rod is depressed at the same speed and the variable speed drive mechanism drives the mop head to rotate at a second rotation speed, wherein the first rotation speed is higher than the second rotation speed.

The advantages of the present invention are as follows: since the mop head of the cleaning tool provided by the present invention can get different rotation speeds under the drying condition with a lower resistance and the washing conditions with a higher resistance, and the first rotation speed is higher than the second rotation speed, the mop of the present invention can rapidly drive the drying basket to realize centrifugal drying. During washing, the mop head is washed rotationally at a lower speed, and the washing operation conducted through depressing the mop rod also saves labor.

In the present invention, the variable speed drive mechanism includes a drive mechanism and a control mechanism, wherein the former can convert the telescoping motion of the mop rod to the rotational motion of the mop head and the later can control different output rotation speeds of the mop head under different working conditions to realize high-speed rotational drying and low-speed rotational cleaning simultaneously, thus achieving the labor-saving depression operation of the mop head under both working conditions.

In the present invention, clamping slots capable of rotating relative to other components of the mop head are accommodated in the mop head and clamps fit for the clamping slots are respectively configured on the drying basket and the washing head. During drying, the mop rod is depressed to drive the clamping slots in the mop head to rotate, which drives the clamps in the drying basket to rotate and further drives the drying basket to rotate.

In the present invention, the drive mechanism comprises: a screw rod fixed with the outer rod and a transmission part fixed inside the inner rod, wherein the transmission part is provided with a rotation part in which screw threads fit for the screw rod are set. A unidirectional transmission mechanism is mounted between the rotation part and the transmission part. The drive mechanism can realize the driving of the rotation of the mop head by depressing the mop rod.

In the present invention, the control mechanism comprises: a clamping chassis configured on the lower cover of the mop head, a speed reduction device accommodated in the mop head and a washing head accommodated in the washing head installation seat which is provided with a clamping seat fit for the clamping chassis; wherein the speed reduction device is a planetary gear transmission whose sun gear is connected with the mop rod and integrated with the clamping slots in the mop head, and whose gear ring is accommodated in the mop disk of the mop head, the lower cover of the mop head and the mop head can rotate relative to each other. The working process of the control mechanism is as follows: when drying, the mop rod is depressed to drive the mop head to rotate and the clamping slots in the mop head drives the clamps in the drying basket to rotate, thus realizing centrifugal drying. When washing the mop, the mop rod is depressed, since a clamping chassis is configured on the lower cover of the mop head and a clamping seat fit for the clamping chassis is configured on the washing head installation seat, the lower cover of the mop head and the washing head installation seat can not rotate relative to each other when the clamping chassis is fixed by the clamping seat. At this time, the mop rod drives the sun gear of the planetary gear transmission; the planetary gear drives the gear ring and further drives the mop disk of the mop head to rotate, thus realizing the speed reducing rotation of the mop head to decrease the resistance of the mop head during washing so as to realize labor-saving washing.

In the present invention, the control mechanism comprises: a clamping chassis configured on the mop head, a washing head and speed reduction device accommodated in the washing head installation seat on which a clamping seat fit for the clamping chassis is configured; wherein the speed reduction device is a planetary gear transmission whose sun gear is connected with the washing head, and whose gear ring is accommodated in the clamping seat. The working process of the control mechanism is as follows: when drying, the mop rod is depressed to drive the mop head to rotate and the clamping slots in the mop head drives the clamps in the drying basket to rotate, thus realizing centrifugal drying. When washing the mop, the mop rod is depressed, and the clamping chassis on the mop head locks the clamping seat on the washing head installation seat so that the mop disk of the mop head and the washing head installation seat can not rotate relative to each other. At this time, the mop rod drives the washing head which drives the sun gear of the planetary gear transmission, the planetary gear drives the gear ring and further drives the rotatable clamping seat and the mop head to rotate, thus realizing the speed reducing rotation of the mop head to decrease the resistance of the mop head during washing so as to realize labor-saving washing.

In the present invention, the control mechanism comprises: a mop rod including three sections of rod parts, wherein a group of drive mechanisms are configured between the upper rod and the middle rod, a first control switch controls the relative rotation and positioning between the upper rod and the middle rod, another group of drive mechanisms are configured between the middle rod and the lower rod, a second control switch controls the relative rotation and positioning between the middle rod and the lower rod, and the screw rods of the two groups of drive mechanisms have different screw pitch. The working process of the control mechanism is as follows: when dehydration, either the first control switch or the second control switch is turned on to make the drive mechanism with shorter screw pitch in the two screw rods to work, at this time, the mop rod is depressed to enable the drive mechanism to output a higher rotation speed, thus realizing high-speed drying. When washing the mop, the other control switch is turned on to make the drive mechanism with longer screw pitch in the two screw rods to work, at this time, the mop rod is depressed to enable the drive mechanism to output a lower rotation speed, thus realizing low-speed rotational washing. It can also simultaneously accomplish the high-speed rotational dehydration and low-speed rotational washing, thus saving labor in depression operation of the mop rod under both working conditions.

In the present invention, the unidirectional transmission mechanism comprises: a transmission gear configured at the bottom of the rotation part, and another transmission gear configured at the bottom of the inner side of the transmission part, wherein the two transmission gears are provided with a mating surface and a sliding surface fit for each other, and the rotation part can move up and down relative to the transmission part; when the rotation part rotates in one direction to let the mating surfaces of the two transmission gear support against each other, a unidirectional transmission is formed; when the rotation part rotates in another direction to let the sliding surfaces of the two transmission gear support against each other, the rotation part moves relative to the transmission part and forms an idle transmission. It can realize unidirectional transmission function.

In the present invention, the unidirectional transmission mechanism comprises: a unidirectional bearing configured between the transmission part and the rotation part, wherein, when the rotation direction of the rotation part is the locking direction of the unidirectional bearing, a unidirectional transmission is formed between the rotation part and the transmission part; when the rotation direction of the rotation part is the free rotation direction of the unidirectional bearing, an idle transmission is formed between the rotation part and the transmission part. It can also realize unidirectional transmission function.

In the present invention, the drying basket and washing head are configured in the same mop bucket. Of course, the drying basket and washing head in the present invention can be configured in different mop buckets respectively. Both of the two structures above can realize the object of the present invention.

In the present invention, a ratchet is configured on the upper part of the clamping slots, and another ratchet fit for the ratchet is configured on the unidirectional control sheet sleeved on the upper part of the clamping slots. The lower cover of the mop head restricts the rotation of the unidirectional control sheet. Carry and rotate the mop rod manually, when the rotation direction is the direction in which the two ratchets are supported against each other, the wiping object on the mop head can be unfolded by means of the interaction between the two ratchets.

In the present invention, a ratchet is configured on the upper part of the clamping slots, and another ratchet fit for the ratchet is configured on the unidirectional control sheet sleeved on the upper part of the clamping slots. The mop disk of the mop head restricts the rotation of the unidirectional control sheet. It can also unfold the wiping object on the mop head by means of the interaction between the two ratchets.

DETAILED DESCRIPTION OF THE INVENTION

Figure 1:
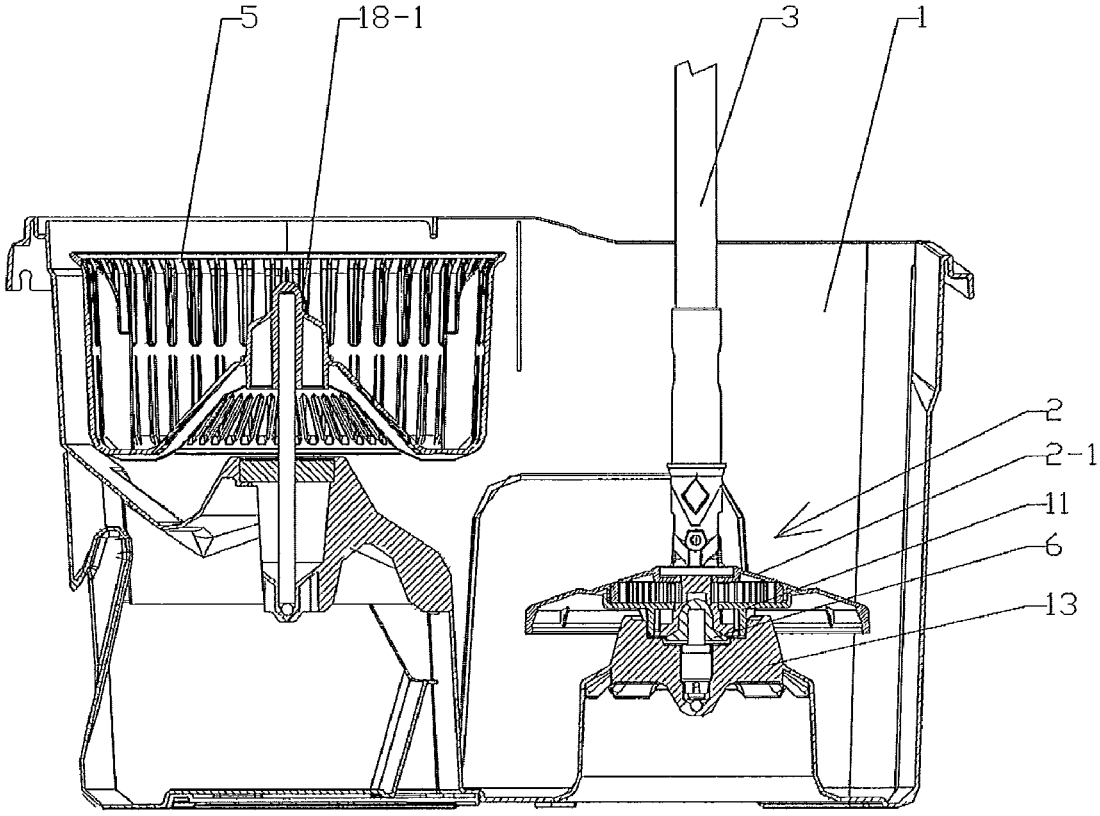
FIG. 1 is the section view of Embodiment 1 of the present invention.
Figure 2:
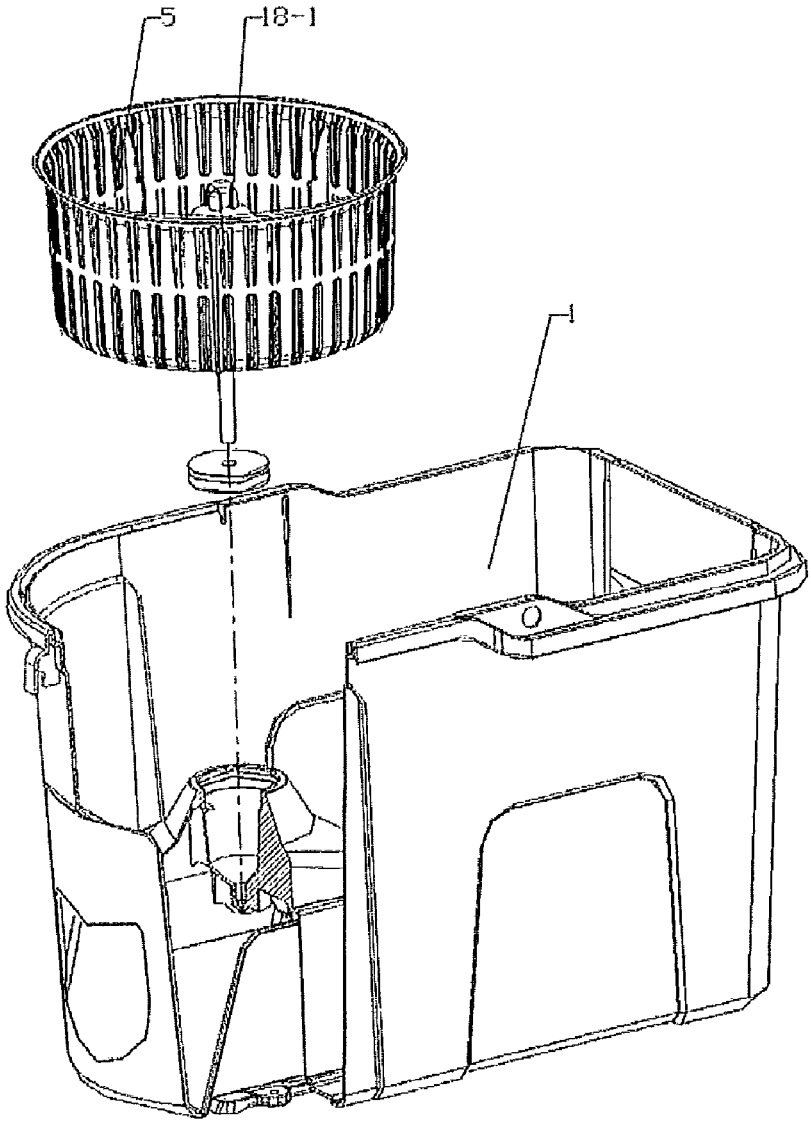
FIG. 2 is the exploded view of the components near the dehydration basket in Embodiment 1 of the present invention.
Figure 3:
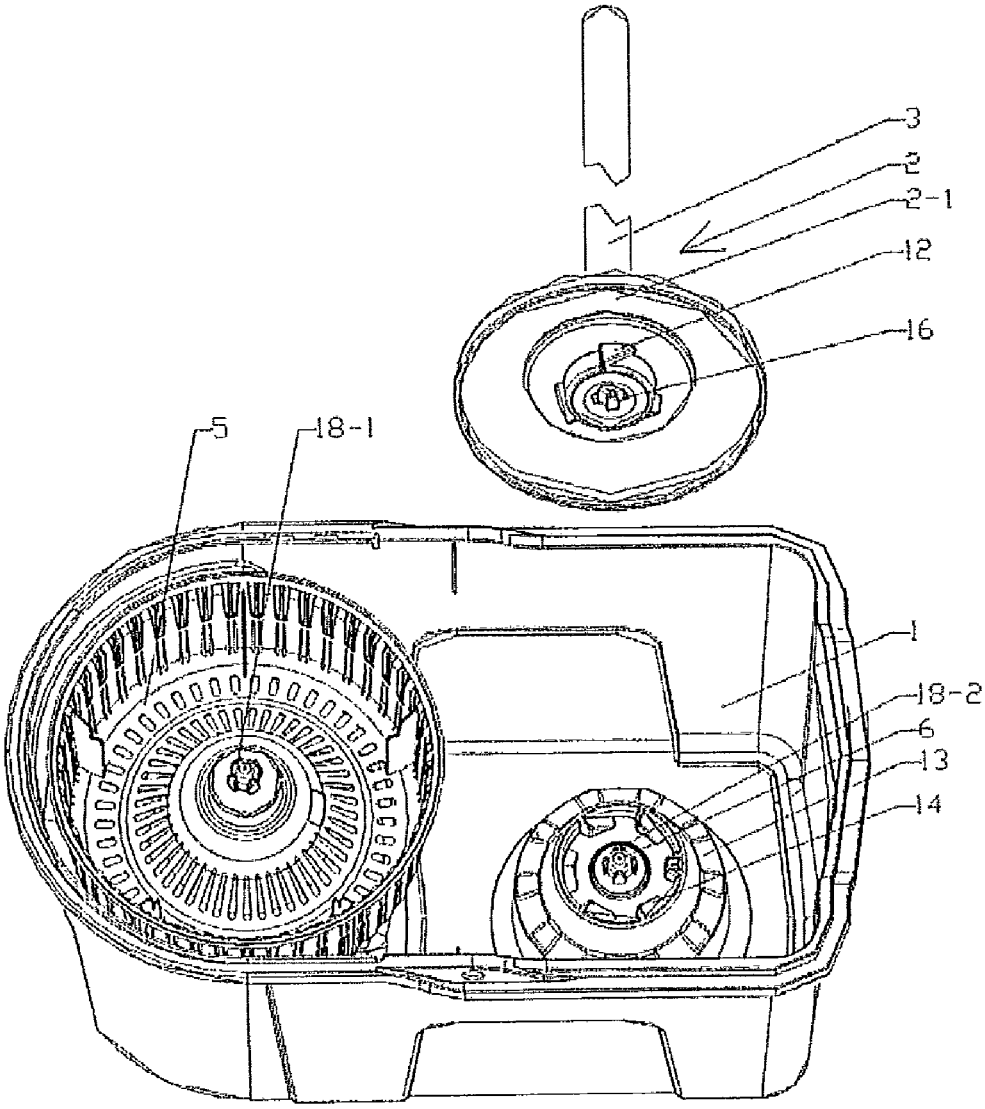
FIG. 3 is the perspective view of Embodiment 1 of the present invention.
Figure 4:
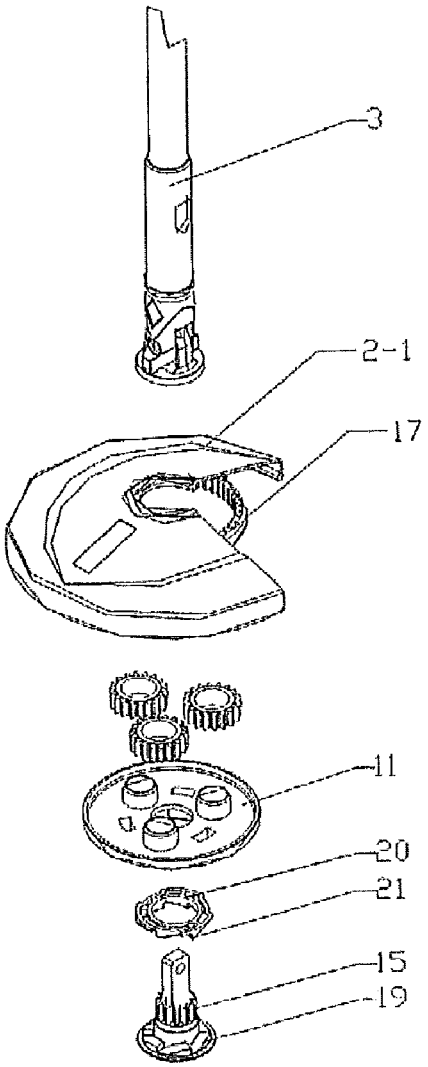
FIG. 4 is the exploded view of the components near the mop head in Embodiment 1 of the present invention.
Figure 5:
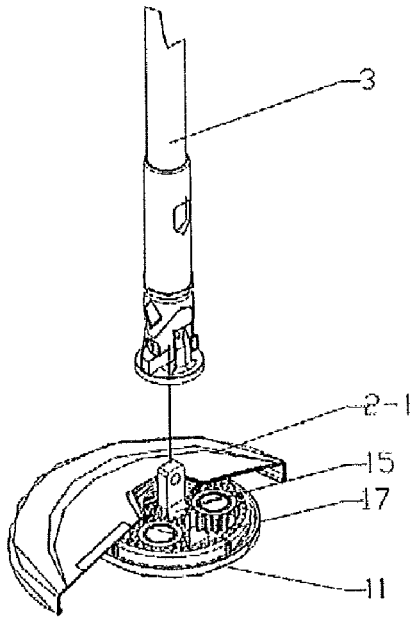
FIG. 5 is the schematic view of the structure of the mop head part in Embodiment 1 in the present invention.
Figure 6:
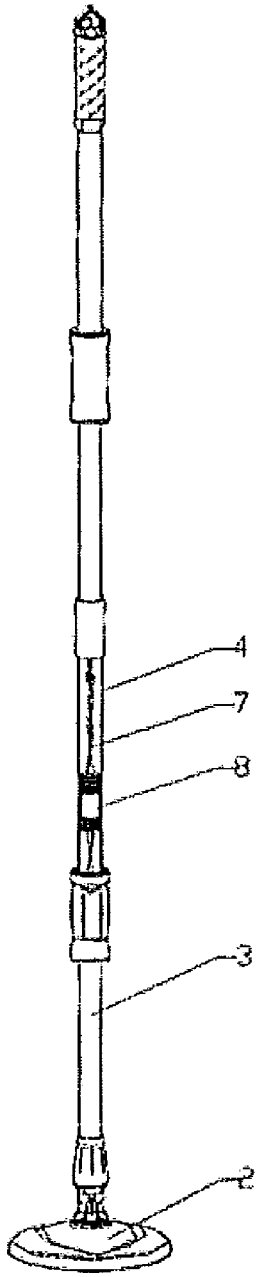
FIG. 6 is the schematic view of the structure of the mop rod in Embodiment 1 of the present invention.
Figure 7:
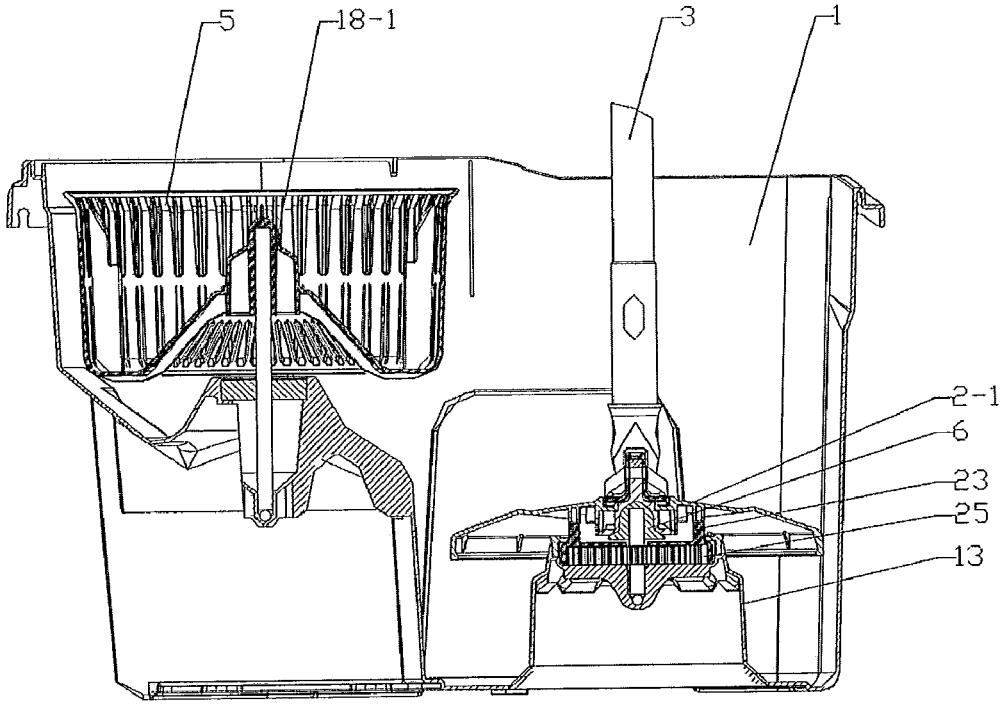
FIG. 7 is the section view of Embodiment 2 of the present invention.
Figure 8:
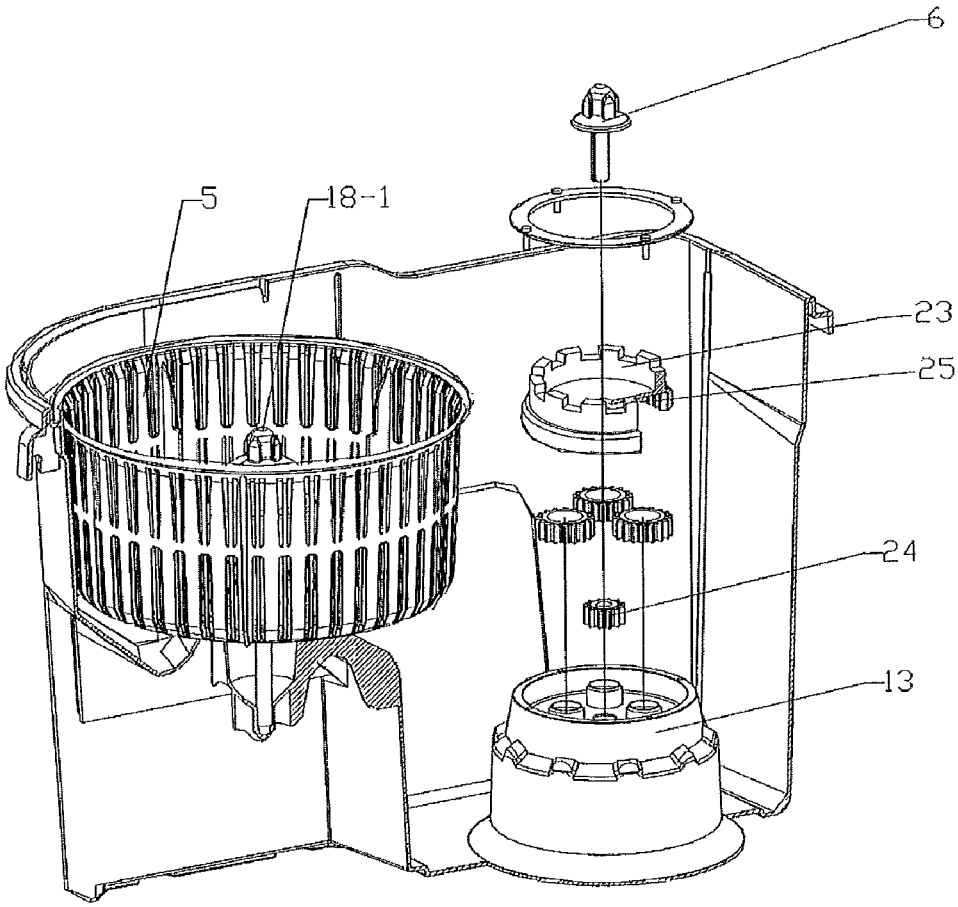
FIG. 8 is the exploded view of the components near the washing head in Embodiment 2 of the present invention.
Figure 9:
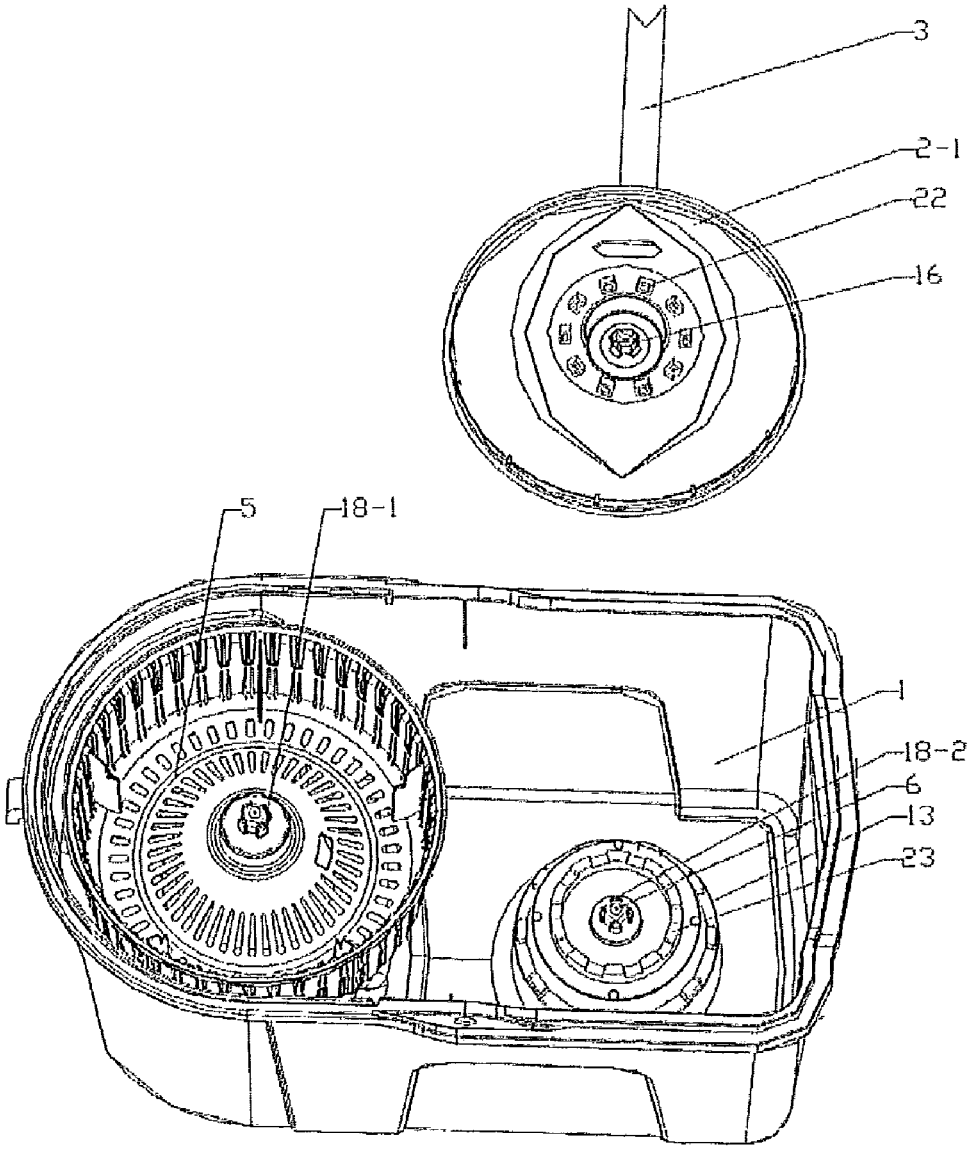
FIG. 9 is the perspective view of Embodiment 2 of the present invention.
Figure 10:
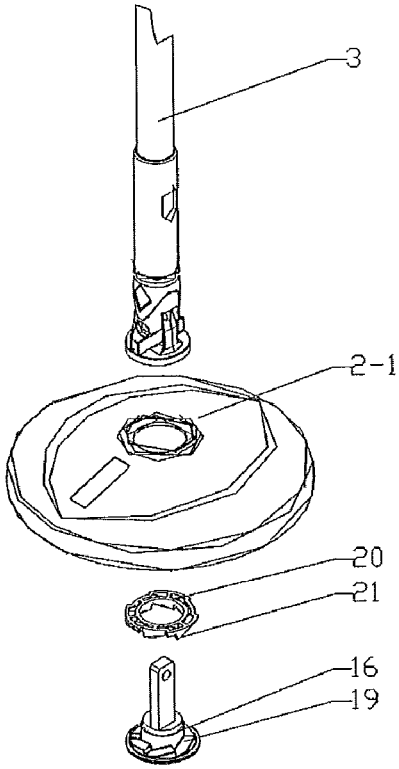
FIG. 10 is the exploded view of the components near the mop head in Embodiment 2 of the present invention.
Figure 11:
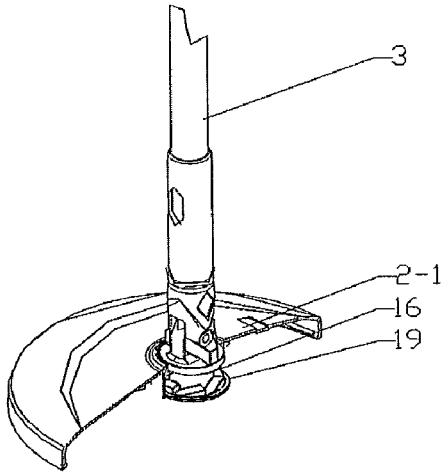
FIG. 11 is the schematic view of the mop head part in Embodiment 2 of the present invention.

According to FIGS. 1-6, FIG. 13 and FIG. 14, a cleaning tool in one exemplary embodiment includes a mop bucket 1 and a mop. The lower end of the mop rod is provided with a mop head 2 with a wiping object. The mop rod includes an inner rod 3 and an outer rod 4. The inner rod 3, whose lower end connects with the mop head 2, and the outer rod are sleeved and joint with each other. The tool includes a drive mechanism, used to convert the telescoping motion of the mop rod to the rotation motion of the mop head, is configured between the inner rod and the outer rod. A rotatable drying basket 5 is accommodated in the mop bucket and during drying, the mop head 2 is put in the drying basket 5 and the drive mechanism drives the mop head and the drying basket to rotate unidirectionally. A rotatable washing head 6 is accommodated in the mop bucket. During washing, the mop head 2 is put on the washing head 6 and the drive mechanism drives the mop head to rotate unidirectionally. The drive mechanism is a variable speed drive mechanism. During drying, the mop rod is depressed and the variable speed drive mechanism drives the mop head to rotate at the first rotation speed. During washing, the mop rod is depressed at the same speed, the variable drive mechanism drives the mop head to rotate at the second rotation speed, wherein the first rotation speed is higher than the second rotation speed.

In the embodiment, the variable speed drive mechanism comprises a drive unit and a control unit. The drive unit comprises a screw rod 7 fixed with the outer rod 4, and a transmission part 8 fixed inside the inner rod, wherein the transmission part 8 is provided with a rotation part 9 in which screw threads 10 fit for the screw rod are set. A unidirectional transmission mechanism is mounted between the rotation part and the transmission part.

In the embodiment, the control unit comprises: a clamping chassis 12 configured on the lower cover 11 of the mop head, a speed reduction device accommodated in the mop head and a washing head 6 accommodated in the washing head installation seat 13 which is provided with a clamping seat 14 fit for the clamping chassis; wherein the speed reduction device is a planetary gear transmission whose sun gear 15 is connected with the mop rod and integrated with the clamping slots 16 in the mop head, and whose gear ring 17 is accommodated in the mop disk 2-1 of the mop head 2, the lower cover 11 of the mop head and the mop head can rotate relative to each other.

In the embodiment, clamping slots 16 capable of rotating relative to other components of the mop head are accommodated in the mop head, and two clamps 18-1 and 18-2 fit for the clamping slots are respectively configured on the drying basket and the washing head. A ratchet 19 is configured on the upper part of the clamping slots and another ratchet 21 fit for the ratchet 19 is configured on the unidirectional control sheet 20 sleeved on the upper part of the clamping slots. The lower cover of the mop head restricts the rotation of the unidirectional control sheet. When the rotation direction is the direction in which the two ratchets above are supported against each other, the wiping object on the mop head can be unfolded by means of the interaction between the two ratchets.

The working process of the embodiment is as follows: when drying, the mop rod is depressed to drive the mop head to rotate and the clamping slots in the mop head drive the clamps in the drying basket to rotate, thus realizing centrifugal drying. When washing the mop, the mop rod is depressed, since a clamping chassis is configured on the lower cover of the mop head and a clamping seat fit for the clamping chassis is configured on the washing head installation seat, the lower cover of the mop head and the washing head installation seat can not rotate relative to each other when the clamping chassis is fixed by the clamping seat. At this time, the mop rod drives the sun gear of the planetary gear transmission, and the planetary gear drives the gear ring and further drives the mop disk of the mop head to rotate, thus realizing the speed reducing rotation of the mop head to decrease the resistance of the mop head during washing so as to realize labor-saving washing.

Since the mop head of the cleaning tool provided by the embodiment can get different rotation speeds under the drying conditions with a lower resistance and the washing conditions with a higher resistance to realize the high-speed rotational drying and low-speed rotational cleaning simultaneously, both the dehydration and cleaning of the mop can save labor.

FIGS. 7-11 show Embodiment 2 of the present invention. The drive mechanism in the embodiment is the same with that in Embodiment 1. The control mechanism of the embodiment comprises: a clamping chassis 22 configured on the mop head 2, a washing head 6 and a speed reduction device accommodated in the washing head installation seat 13 on which a clamping seat 23 fit for the clamping chassis 22 is configured; wherein the speed reduction device is a planetary gear transmission whose sun gear 24 is connected with the washing head, and whose gear ring 25 is accommodated in the clamping seat 23. Other components in the embodiment are the same with those in Embodiment 1, which can also realize the object of the present invention.

The working process of the embodiment is as follows: when drying, the mop rod is depressed to drive the mop head to rotate and the clamping slots in the mop head drives the clamps in the dehydration basket to rotate, thus realizing centrifugal dehydration. When washing the mop, the mop rod is depressed; the clamping chassis on the mop head locks the clamping seat on the washing head installation seat so that the mop disk of the mop head and the washing head installation seat can not rotate relative to each other. At this time, the mop rod drives the washing head which further drives the sun gear of the planetary gear transmission, the planetary gear drives the gear ring which further drives the rotatable clamping seat and the mop head to rotate, thus realizing the speed reducing rotation of the mop head to decrease the resistance of the mop head during washing so as to realize labor-saving washing.

Figure 12:
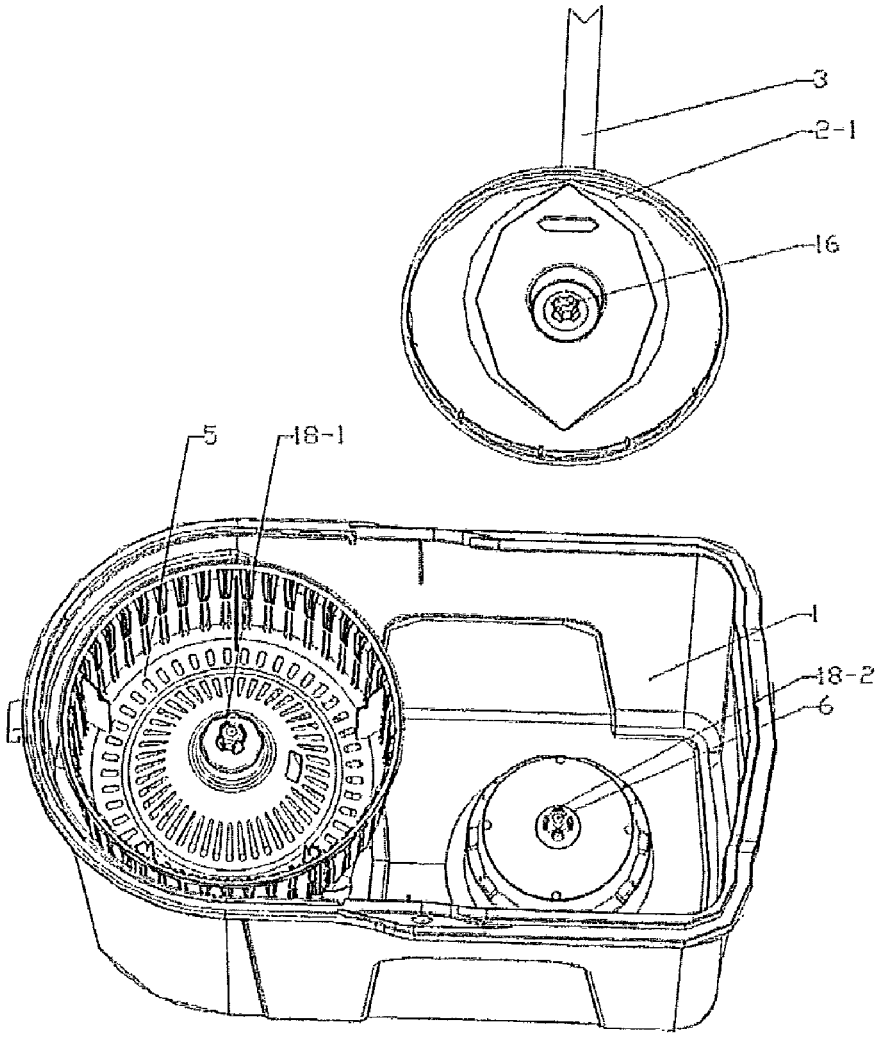
FIG. 12 is the perspective view of Embodiment 3 of the present invention.
Figure 13:
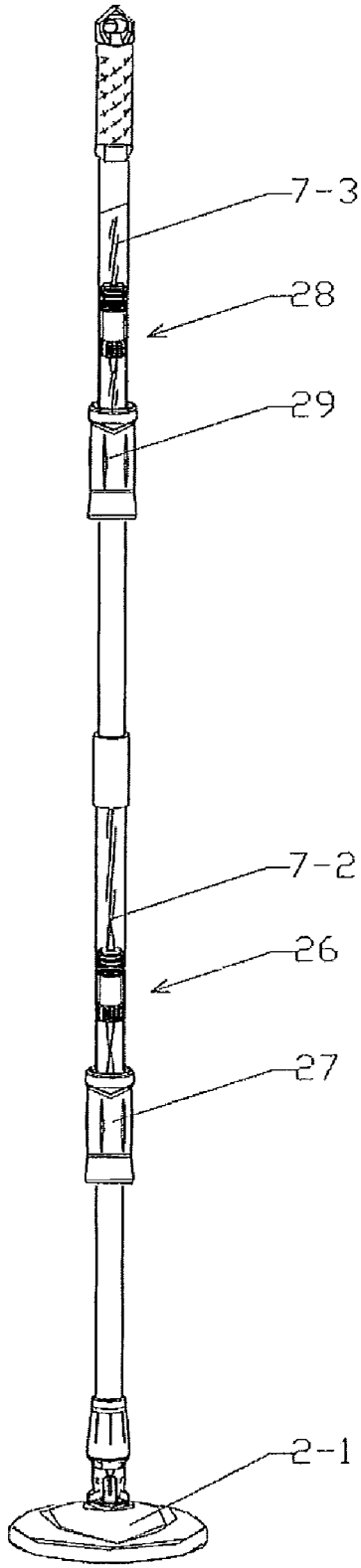
FIG. 13 is the partial section view of the mop rod in Embodiment 3 of the present invention.

FIGS. 12 and 13 show Embodiment 3 of the present invention. In the embodiment, the control mechanism comprises: a mop rod including three sections of rod parts, wherein a group of drive mechanisms 26 are configured between the upper rod and the middle rod, a first control switch 27 controls the relative rotation and positioning between the upper rod and the middle rod, another group of drive mechanisms 28 are configured between the middle rod and the lower rod, a second control switch 29 controls the relative rotation and positioning between the middle rod and the lower rod, and the screw rods 7-2 and 7-3 of the two groups of drive mechanisms have different screw pitch.

The working process of the embodiment is as follows: when drying, either the first control switch or the second control switch is turned on to make the drive mechanism with shorter screw pitch in the two screw rods to work, at this time, the mop rod is depressed to enable the drive mechanism to output a higher rotation speed, thus realizing high-speed drying. When washing the mop, the other control switch is turned on to make the drive mechanism with longer screw pitch in the two screw rods to work, at this time, the mop rod is depressed to enable the drive mechanism to output a lower rotation speed, thus realizing low-speed rotational washing. The embodiment can also simultaneously accomplish the high-speed rotational drying and low-speed rotational washing, thus saving labor in depression operation of the mop rod under both working conditions.

Figure 14:
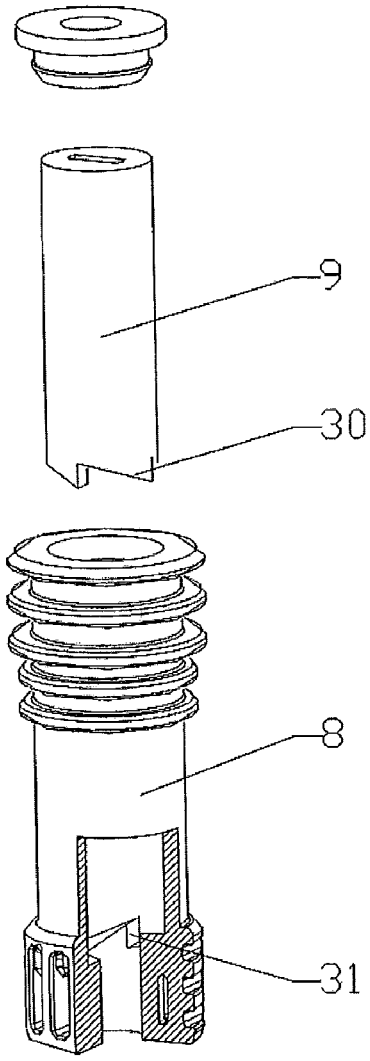
FIG. 14 is the exploded view of a unidirectional transmission mechanism of the present invention.
Figure 15:
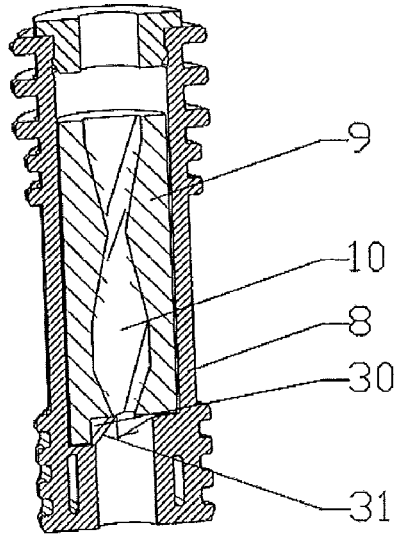
FIG. 15 is the section view of a unidirectional transmission mechanism of the present invention.

FIGS. 14 and 15 show a unidirectional transmission mechanism according to the present invention. In the embodiment, the unidirectional transmission mechanism comprises: a transmission gear 30 configured at the bottom of the rotation part 9, and another transmission gear 31 configured at the bottom of the inner side of the transmission part 8, wherein the two transmission gears are provided with a mating surface and a sliding surface fit for each other, and the rotation part can move up and down relative to the transmission part; when the rotation part rotates in one direction to let the mating surfaces of the two transmission gear support against each other, a unidirectional transmission is formed; when the rotation part rotates in another direction to let the sliding surfaces of the two transmission gear support against each other, the rotation part moves relative to the transmission part and forms an idle transmission. It can realize unidirectional transmission function.

Figure 16:
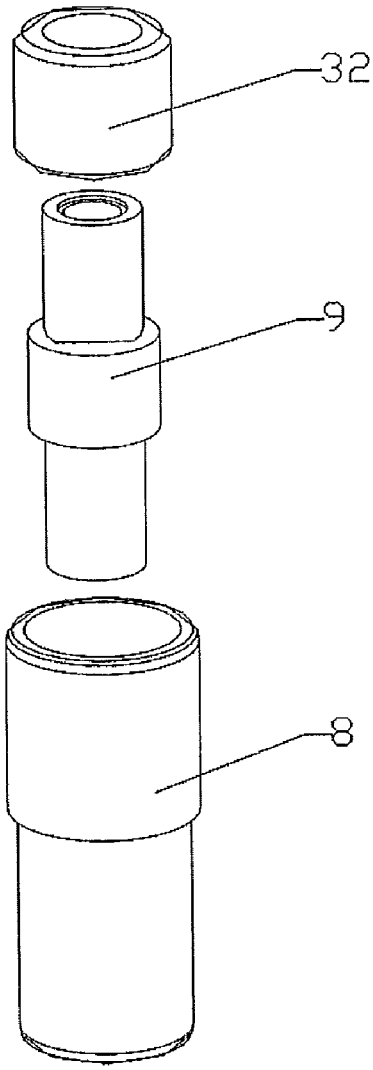
FIG. 16 is the exploded view of another unidirectional transmission mechanism of the present invention.
Figure 17:
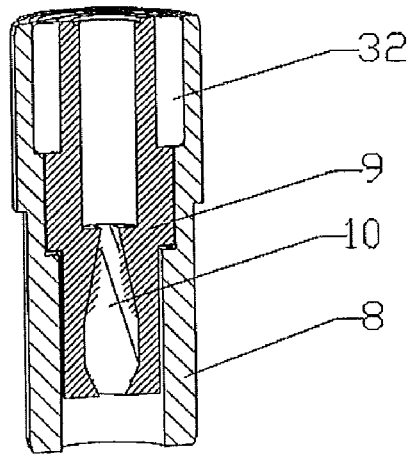
FIG. 17 is the section view of another unidirectional transmission mechanism of the present invention.

FIGS. 16 and 17 show another unidirectional transmission mechanism according to the present invention. In the present invention, the unidirectional transmission mechanism comprises: a unidirectional bearing 32 configured between the transmission part 8 and the rotation part 9, wherein, when the rotation direction of the rotation part is the locking direction of the unidirectional bearing, a unidirectional transmission is formed between the rotation part and the transmission part; when the rotation direction of the rotation part is the free rotation direction of the unidirectional bearing, an idle transmission is formed between the rotation part and the transmission part. It can also realize unidirectional transmission function.

In the present invention, the dehydration basket and washing head are configured in the same mop bucket. Of course, the drying basket and washing head in the present invention can be configured in different mop buckets respectively. Both of the two structures above can realize the object of the present invention.

The embodiments above are only the individual cases for application of the present invention. Any such change and combination of the embodiments according to the spirit of the present invention should be covered in the scope of protection of the present invention.

What is claimed is:

1. A cleaning tool, comprising:

a mop bucket and a mop, wherein a lower end of a mop rod is provided with a mop head with a wiping object, and the mop rod includes an inner rod and an outer rod; the inner rod, whose lower end connects with the mop head, and the outer rod are sleeved and joined with each other, and a drive mechanism, used to convert the telescoping motion of the mop rod to rotational motion of the mop head, is mounted between the inner rod and the outer rod;

a rotatable drying basket is accommodated in the mop bucket, during drying, the mop head is put in the drying basket and the drive mechanism drives the mop head and the drying basket to rotate unidirectionally; the mop bucket is provided with a rotatable washing head on which the mop head is put during washing; the drive mechanism drives the mop head to rotate unidirectionally;

wherein the drive mechanism is a variable speed drive mechanism; during drying, the mop rod is depressed and the variable speed drive mechanism drives the mop head to rotate at a first rotation speed; during washing, the mop rod is depressed at the same speed and the variable speed drive mechanism drives the mop head to rotate at a second rotation speed, wherein the first rotation speed is higher than the second rotation speed.

2. The cleaning tool according to claim 1, wherein the variable speed drive mechanism comprises a drive unit and a control unit.

3. The cleaning tool according to claim 2, wherein the drive unit comprises: a screw rod fixed with the outer rod and a transmission part fixed inside the inner rod, wherein the transmission part is provided with a rotation part in which screw threads fit for the screw rod are set; and a unidirectional transmission mechanism mounted between the rotation part and the transmission part.

4. The cleaning tool according to claim 3, wherein the control unit comprises: the mop rod including three sections of rod parts, wherein a group of drive units are configured between the upper rod and the middle rod, a first control switch controls the relative rotation and positioning between the upper rod and the middle rod, another group of drive units are configured between the middle rod and the lower rod, a second control switch controls the relative rotation and positioning between the middle rod and the lower rod, and the screw rods of the two groups of drive units have different screw pitch.

5. The cleaning tool according to claim 3, wherein the unidirectional transmission mechanism comprises: a transmission gear configured at the bottom of the rotation part, and another transmission gear configured at the bottom of the inner side of the transmission part, wherein the two transmission gears are provided with a mating surface and a sliding surface fit for each other, and the rotation part can move up and down relative to the transmission part; when the rotation part rotates in one direction to let the mating surfaces of the two transmission gear support against each other, a unidirectional transmission is formed; when the rotation part rotates in another direction to let the sliding surfaces of the two transmission gear support against each other, the rotation part moves relative to the transmission part and forms an idle transmission.

6. The cleaning tool according to claim 3, wherein the unidirectional transmission mechanism comprises: a unidirectional bearing configured between the transmission part and the rotation part, wherein, when the rotation direction of the rotation part is the locking direction of the unidirectional bearing, a unidirectional transmission is formed between the rotation part and the transmission part; when the rotation direction of the rotation part is the free rotation direction of the unidirectional bearing, an idle transmission is formed between the rotation part and the transmission part.

7. The cleaning tool according to claim 2, wherein the control unit comprises: a clamping chassis configured on the lower cover of the mop head, a speed reduction device accommodated in the mop head and the washing head being accommodated in a washing head installation seat which is provided with a clamping seat fit for the clamping chassis; wherein the speed reduction device is a planetary gear transmission whose sun gear is connected with the mop rod and integrated with the clamping slots in the mop head, and whose gear ring is accommodated in the mop disk of the mop head, the lower cover of the mop head and the mop head can rotate relative to each other.

8. The cleaning tool according to claim 7, wherein a first ratchet is configured on the upper part of the clamping slots, and another second ratchet is configured on the unidirectional control sheet sleeved on the upper part of the clamping slots; the lower cover of the mop head restricts the rotation of the unidirectional control sheet, wherein the first and second ratchets are configured to mate together.

9. The cleaning tool according to claim 2, wherein the control unit comprises: a clamping chassis configured on the mop head, a washing head and speed reduction device accommodated in the washing head installation seat on which a clamping seat fit for the clamping chassis is configured, wherein the speed reduction device is a planetary gear transmission whose sun gear is connected with the washing head, and whose gear ring is accommodated in the clamping seat.

10. The cleaning tool according to claim 9, wherein a first ratchet is configured on the upper part of the clamping slots, and another second ratchet is configured on the unidirectional control sheet sleeved on the upper part of the clamping slots; the mop disk of the mop head restricts the rotation of the unidirectional control sheet, wherein the first and second ratchets are configured to mate together.

11. The cleaning tool according to claim 1, wherein clamp slots capable of rotating relative to other components of the mop head are configured in the mop head, and clamps fit for the clamping slots are respectively configured on the drying basket and the washing head.

12. The cleaning tool according to claim 1, wherein the drying basket and the washing head are configured in the same mop bucket.

13. The cleaning tool according to claim 1, wherein the drying basket and the washing head are configured in different portions of the mop bucket.

* * * * *